US006298594B1

(12) United States Patent
Strayer

(10) Patent No.: US 6,298,594 B1
(45) Date of Patent: Oct. 9, 2001

(54) INTERCHANGEABLE TRIGGER SYSTEM FIREARMS

(76) Inventor: Sandy L. Strayer, 7409 Boca Raton, North Richland Hills, TX (US) 76180

( * ) Notice: Subject to any disclaimer, the term of this patent is extended or adjusted under 35 U.S.C. 154(b) by 0 days.

(21) Appl. No.: 09/227,325

(22) Filed: Jan. 6, 1999

Related U.S. Application Data

(60) Provisional application No. 60/070,867, filed on Jan. 9, 1998.

(51) Int. Cl.[7] ..... F41A 19/00; F41A 19/10

(52) U.S. Cl. ..... 42/69.01; D22/108

(58) Field of Search ..... 42/69.01, 70.07; D22/108

(56) References Cited

U.S. PATENT DOCUMENTS

| | | | | |
|---|---|---|---|---|
| D. 371,591 | * | 7/1996 | Lenkarski et al. | D22/108 |
| 851,626 | * | 4/1907 | Keyse | 42/69.01 |
| 938,192 | * | 10/1909 | Williams | 42/69.01 |
| 1,285,885 | * | 11/1918 | Younger | 42/69.01 |
| 1,513,654 | * | 10/1924 | Thompson | 42/69.01 |
| 1,521,286 | * | 12/1924 | Fisher | 42/69.01 |
| 1,837,093 | * | 12/1931 | Andrews | 42/69.01 |
| 1,909,425 | * | 5/1933 | Reid | 52/69.01 |
| 4,005,540 | * | 2/1977 | Robinson | 42/69.01 |
| 4,028,835 | * | 6/1977 | Canjar | 42/69.01 |
| 4,514,923 | * | 5/1985 | Teel | 42/69.01 |
| 4,667,429 | * | 5/1987 | Perazzi | 42/69.01 |
| 5,724,760 | * | 3/1998 | Langner | 42/70.07 |
| 5,822,903 | * | 10/1998 | Davis, Sr. | 42/69.01 |
| 6,070,512 | * | 6/2000 | Rohrbaugh | 42/70.07 |

* cited by examiner

*Primary Examiner*—Darren W. Ark

(57) ABSTRACT

A firearm having a frame, barrel, trigger guard and firing assembly and having a trigger for actuating the firing assembly. A trigger mount is connected to the trigger and, when the trigger is in assembly within the frame, is at least partially positioned within the trigger guard. The trigger mount defines a first interlocking geometry. A plurality of trigger shoe elements each having a differing geometry and dimension and provided with a finger engaging portion are provided for selection by a user. Each of the trigger shoe elements defines a second interlocking geometry which is capable of mating with the first interlocking geometry of the trigger mount. Thus, a user of the firearm is enabled to release and remove a trigger shoe from the trigger mount, even when the trigger is in assembly within the firearm and replace it with a trigger shoe element of a different design and dimension and thereby achieve the desired fit and "feel" of the firearm which is desired by the user.

13 Claims, 2 Drawing Sheets

INTERCHANGEABLE TRIGGER SYSTEM FIREARMS

The benefit of United States Provisional Application Ser. No. 60/070,867, filed on Jan. 9, 1998 by Sandy L. Strayer and entitled "Interchangeable Trigger System For Handguns" is hereby claimed.

BACKGROUND OF THE INVENTION

1. Field of the Invention

The present invention relates generally to trigger actuated firearms including rifles, shotguns, pistols, machine guns and the like which have a firing mechanism that is actuated by manually operating a trigger element which is engaged by a finger of a user and defines a finger engaging geometry. More particularly, the present invention concerns triggers for firearms which define a trigger receptacle for receiving any one of a number of trigger pad elements to thus enable the user of the firearm to provide the firearm with a desired trigger configuration and dimension.

2. Description of the Prior Art

Though the present invention is discussed herein particularly as it relates to handguns which incorporate features and functional components based on the 1911 A1 Government Model handgun, it is to be understood that such discussion is intended solely to promote an understanding of this invention. Within the spirit and scope of the present invention it is to be appreciated that the present invention has application in many other types of firearms, including shoulder fired firearms, machine guns, handguns that are manually fired by actuating a trigger element by manually moving it with a finger, typically the index finger of the user. The term "trigger" as used herein is intended to mean any firearm element which is moved by a finger of a user to actuate the firing mechanism of the firearm and cause firing of a cartridge for propelling bullets through and from a barrel of the firearm.

The 1911 A1 Government Model handgun has been widely manufactured for many years, particularly for military and police use as well as for personal use and early on was historically adapted only for a .45 caliber ACP cartridge. Subsequently, the Government Model 1911 A1 handgun has been adapted for cartridges of other caliber and configuration and at the present time variations thereof are widely utilized for target shooting matches.

Though the present invention has application in a wide variety of firearms as indicated above, it has significant application from the standpoint of handguns, because handguns are typically held and fired with one hand. Virtually all handguns have a handgrip that is gripped by a hand, thumb and fingers of the user in a manner allowing the index finger of the user, typically referred to as the "trigger finger", to be utilized for controllably actuating the trigger element of the handgun. In many cases, the other hand of the user is utilized in an overlapping grip with the primary gun supporting hand for the purpose of providing enhanced steadying the handgun during shooting activities, especially during rapid fire conditions where the recoil force of individual shots is absorbed by both hands of the user. Even in two handed shooting activities, however, the handgun is primarily gripped by the "gun hand" of the user, whether the gun hand be the right hand or the left hand.

It is well known that during handgun shooting, the "feel" and comfort of fit of the handgun to the hand of the user is paramount to shooting efficiency and accuracy. When a handgun is gripped by a hand of a user, the trigger finger should comfortably fit the location and geometry of the finger engaging surface of the trigger element of the handgun to provide the level of "feel" and comfort of fit that is desired by the user. For the reason that the anatomy and size of the hands of users differ significantly, it is often necessary for handgun users to adapt the manner by which a handgun is held in order to compensate for the lack of fit and "feel" when the handgun is held. It is considered more desirable however to adapt the handgun to the user rather than adapt the user to the handgun. In some cases, handguns are manufactured on special order to fit the hand of the user. This, however, is a very expensive option and is therefore not available to a wide range of handgun users. At times the handgrip of a handgun is modified to fit the hand of a particular user, but this is also a relatively expensive option that is not widely utilized.

One solution to providing desired location and configuration of the trigger of a handgun is to manufacture a wide variety of trigger elements having trigger shoes of differing dimension and configuration and thereby permit the user to select a desired trigger element and substitute it for a trigger that does not provide the desired fit or "feel". This solution, however, would require manufacturers to maintain an inventory including a wide variety to trigger elements so that users can experiment with trigger replacements until the proper fit and "feel" of the handgun has been achieved. This solution would typically make it necessary for users to disassemble and reassemble a handgun a number of times until the desired trigger "feel" has been identified and would make it more practical to accomplish trigger conversion in shop rather than field conditions because nearly complete disassembly of the handgun would be necessary. Maintaining a large inventory of firearm triggers by persons or companies involved in handgun conversion is obviously a relatively expensive proposition and is thus impractical. It is desirable to provide for changing the fit and "feel" of a firearm, particularly a handgun, by changing out only a portion of the trigger thereof. It is also desirable to provide for trigger conversion in firearms which can be readily accomplished in field or shop conditions without requiring disassembly of the firearm mechanism.

SUMMARY OF THE INVENTION

It is a primary feature of the present invention to provide a trigger for a firearm which can be modified as to dimension and/or configuration without necessitating complete replacement of the trigger of the firearm;

It is also a feature of the present invention to provide a trigger for a firearm which can be modified as to dimension and/or configuration without necessitating complete disassembly of the firearm;

It is another feature of the present invention to provide a trigger for a firearm which defines a seat, mount or receptacle to which can be retained any one of a number of different trigger fixtures to thus enable the user of the firearm to simply and efficiently change the dimension and/or configuration of the trigger, and thus adapt the firearm more specifically to a desired geometry.

Briefly, the various objects and features of the present invention are realized by providing a trigger for a firearm which has a trigger mount defining a receptacle or trigger shoe fixture connection of desired configuration. A number of trigger shoe elements are provided, each having a different dimension and/or configuration. Each of the trigger shoe elements defines a mounting connection that precisely fits the receptacle or trigger shoe fixture, thus enabling the trigger shoes of the trigger mount to be interchanged as desired by the user. The trigger mechanism also employs means, such as one or more set screws to secure the selected trigger shoe to be secured in fixed relation with the trigger mount.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an elevational view showing a handgun which incorporates a trigger mechanism embodying the principles of the present invention;

FIG. 2 is an isometric illustration showing the trigger of the present invention and showing the trigger mount without a trigger shoe present therein;

Figure 1:
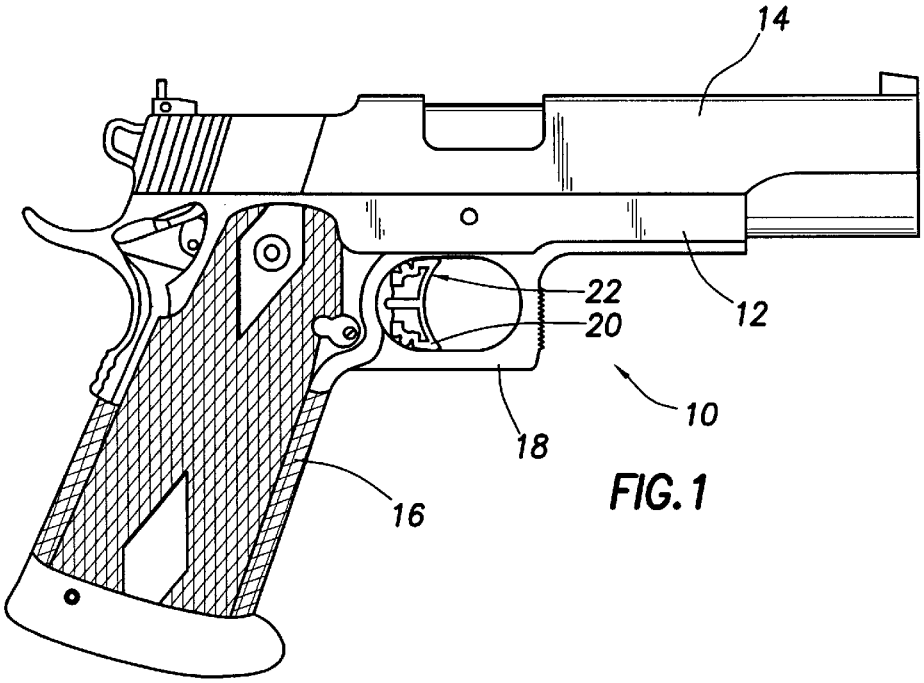
Figure 2:
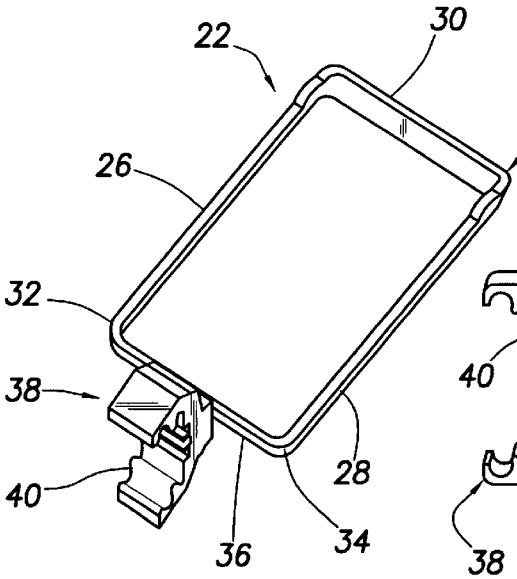
Figure 3:
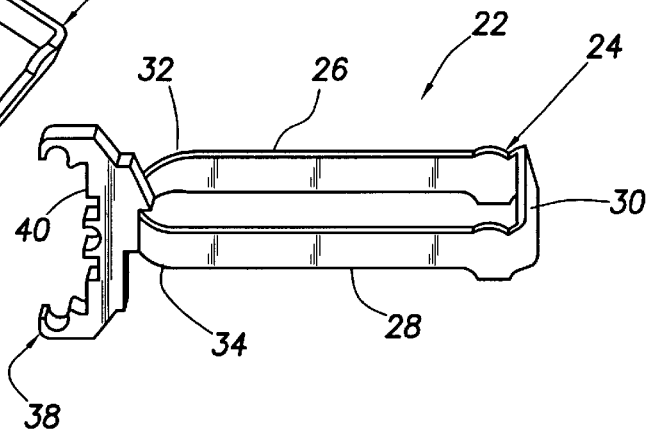
Figure 4:
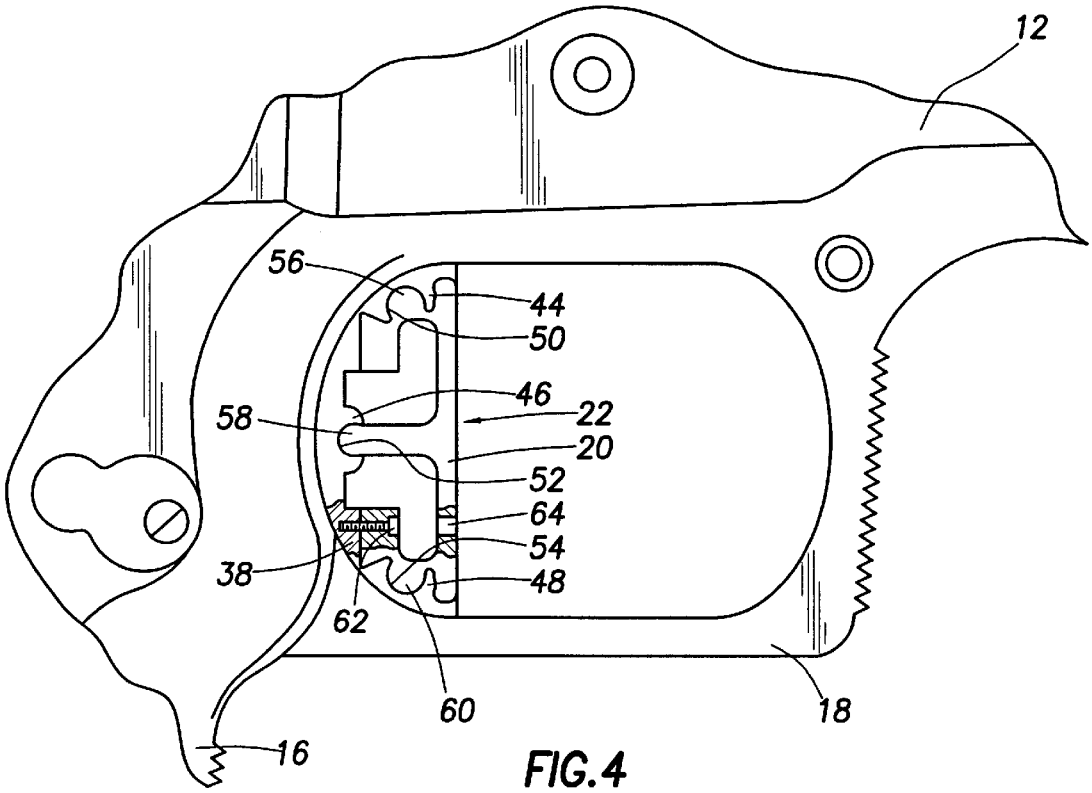
Figure 5:
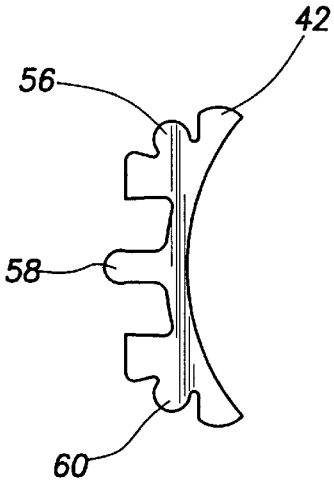

FIG. 3 an isometric illustration of the trigger of FIG. 2 showing the trigger mount without a trigger shoe present therein;

FIG. 4 is a fragmentary elevational view of the handgun of FIG. 1, showing the trigger assembly thereof in detail and showing a trigger shoe seated within the trigger shoe receptacle of the trigger mount; and FIGS. 5–8 are elevational views of various trigger shoe elements that are each adapted to be seated within the trigger shoe receptacle of FIG. 4.

DETAILED DESCRIPTION OF PREFERRED EMBODIMENT

Referring now to the drawings and first to FIG. 1, a handgun embodying the principles of the present invention is shown generally at 10 and incorporates a frame assembly shown generally at 12 which defines guide rails for receiving a slide 14 in reciprocating relation therewith. The frame assembly 12 is provided with a handgrip 16 and a trigger guard 18 within which the finger engaging part or trigger shoe 20 of a trigger shown generally at 22 is movably positioned. The finger engaging part or trigger shoe 20 of the trigger 22 is of interchangeable construction as will be explained in detail hereinbelow. For purposes of simplicity, it is to be understood that the handgun 10 is merely representative of a type of firearm within which the present invention may be embodied. The handgun 10 is not described in detail, it being understood that the handgun shown in FIG. 1 is of the general character of the magazine fed Government Model 1911 A1 semi-automatic handgun and thus incorporates the basic operating mechanism thereof. The handgun 10 that is shown in FIG. 1 is, however, a match grade magazine fed, semi-automatic handgun wherein the handgrip and trigger guard are integral and composed of a polymer material with metal inserts. The handgrip and trigger guard unit is secured in fixed assembly with a frame element 12 which defines guide rails with which the slide has interfitting, longitudinally movable, reciprocating relation. Additionally, the handgrip 16 may define a wide magazine opening, permitting the use of an enhanced volume, staggered row type magazine for containing and feeding cartridges. With regard to the present invention however, it is to be understood that the present invention may be incorporated within the magazine fed Government Model 1911 A1 semi-automatic handgun without any change thereto other than changing out the trigger thereof with an interchangeable trigger assembly that is constructed in accordance with the principles of the present invention. The present invention may be also incorporated within a wide variety of other firearms as well.

Referring now to FIGS. 2 and 3, the trigger shown generally at 22 is adapted for interchangeable configuration and dimension and incorporates a trigger bow shown generally at 24 having a pair of generally straight and parallel side elements 26 and 28 which are interconnected at the rear ends thereof by a rear transverse element 30 which is preferably formed integrally with the side elements by bending sheet metal stock. The generally parallel side elements 26 and 28 merge with integral curved trigger bow sections 32 and 34 which, in turn merge with a forward transverse trigger bow section 36. Thus, the trigger bow 24 is of generally rectangular configuration having curved forward shoulders 32 and 34.

To the forward transverse trigger bow section 36 is fixed a trigger mount shown generally at 38 which defines a receptacle or seat 40 defining a seat geometry with which each of a plurality of trigger shoe elements 20 will interfit. Preferably, the trigger shoe receptacle or seat 40 and the mating geometry of each trigger shoe element 20 establish an interlocking relation so that separation of a trigger shoe element from the trigger shoe receptacle will not be permitted when the trigger shoe is forced forwardly, toward the muzzle of the gun barrel, or rearwardly, away from the muzzle of the gun barrel, but will be permitted only with transverse or lateral movement of the trigger shoe from the trigger shoe receptacle, i.e., toward one of the sides of the firearm.

With reference now to FIG. 4, to permit the establishment of a selective interlocking relationship with a plurality of trigger shoe elements of differing geometry and dimension, the trigger mount 38 defines three mount bosses 44, 46 and 48, each defining a generally arcuate receptacle 50, 52 and 54. Conversely, each of the trigger shoe elements 20 define three curved or arcuate connector elements 56, 58 and 60 which are located so as to be received within the respective arcuate receptacles 50, 52 and 54 regardless of the dimension and configuration of other portions of the trigger shoe element. Thus, each trigger shoe element will have proper interengaging relation with the trigger mount. The interlocking geometry of the trigger mount and trigger shoe prevents forward or rearward movement of the trigger shoe relative to the trigger mount but permits lateral or sidewise relative movement during assembly and disassembly of the trigger shoe from the trigger mount. When a trigger shoe has been placed in interlocking assembly with the trigger mount, it is secured in fixed relation with the trigger mount by a retainer screw or by another suitable retainer means.

FIGS. 5–8 are side elevational views each showing a trigger shoe element of a particular design and dimension. A user of a firearm embodying the present invention has the capability of choosing one of the trigger shoe elements shown in the various Figs. or any other trigger shoe element of differing design and dimension and positioning it in interlocking assembly with the trigger mount of the firearm. Thus, the user can selectively interchange trigger shoe elements until the fit and "feel" of the firearm is satisfactory.

Figure 6:
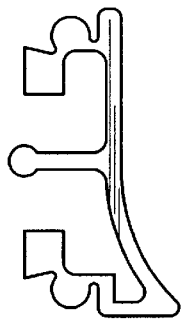
Figure 7:
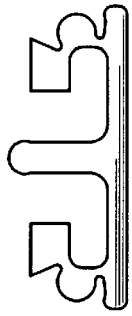
Figure 8:
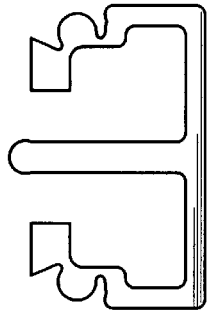

Moreover, this can be done without necessitating disassembly of the firearm, so that fitting the firearm to the user can be accomplished in field conditions through use of a simple tool such as an Allen wrench. It should be noted that the three curved or arcuate connector elements 56, 58 and 60 are identified in the embodiment of FIG. 5 for purposes of explanation. It should also be noted that each of the other embodiments of FIGS. 6–8 are each also provided with three curved or arcuate connector elements having identical relative positions as shown and described above in connection with FIG. 4. Thus, it is intended to be apparent that each of the trigger shoe elements shown in FIGS. 5–8 will establish a precise fit with the trigger mount 38 of FIG. 4. It should also be borne in mind that the specific configuration of the trigger mount 38 and the trigger shoe elements is not intended to be limiting of the present invention. It is intended that the spirit and scope of the present invention encompass any trigger mount and trigger shoe configuration that establish an interlocking relation to permit separation of a trigger shoe element from its trigger mount by lateral movement. Further, it is intended that the spirit and scope of the present invention also encompass any other geometric relationship of a trigger mount and a variety of trigger shoe elements that are simply interconnected by suitable connector means.

As shown in the fragmentary section of FIG. 4 the trigger shoe element 20 is secured against lateral movement from its properly seated position by a retainer screw 62 which is threadedly received by threaded screw hole defined in the trigger mount 38. To enable the retainer screw 62 to be actuated, the trigger shoe element 20 may define an opening 64 to enable an Allen wrench or other screw actuator device to engage within the actuator receptacle of the screw.

The design and location of the interlocking components and receptacles of the trigger mount 38 and the replaceable trigger shoe 20 permits the trigger shoe to be removed and replaced without necessitating disassembly of the firearm. When the trigger is installed in assembly within the frame of the firearm the seat or receptacle 40 of the trigger mount will be exposed within the finger opening of the trigger guard 18. The user of the firearm may simply insert a selected trigger shoe 20 laterally or sidewise into the receptacle or seat of the trigger mount 38 and secure it with a retainer screw 62. Thus, even in field conditions, trigger shoe elements may be interchanged until the firearm has the desired fit and "feel" that is intended by the user.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. An interchangeable trigger system for a firearm having a frame defining opposed sides and having a trigger guard, comprising:

(a) a trigger element adapted for assembly within a firearm and when in assembly with the firearm having forward and rearward linear trigger movement;

(b) a trigger mount being disposed in fixed relation with said trigger element and defining a mounting seat having an interlocking mount geometry;

(c) a plurality of trigger shoe elements each defining a finger engaging portion for engagement by a finger of a user of the firearm and each being of differing dimension and configuration, each of said plurality of trigger shoe elements having a matching interlocking mount geometry for interfitting interlocking relation with said interlocking mount geometry of said mounting seat, said interlocking mount geometry and said matching interlocking mount geometry having interengaging structure permitting assembly and removal of each of said trigger shoe elements only by sidewise lateral movement of each of said trigger shoe elements toward either side of said frame relative to said interlocking mount geometry and preventing assembly and removal of each of said trigger shoe elements with respect to said interlocking mount geometry in any other direction of relative movement when the trigger element is in assembly with the firearm; and (d) means retaining a selected one of said plurality of trigger shoe elements in assembly with said trigger mount.

2. The interchangeable trigger system of claim 1, comprising:

(a) said interlocking mount geometry having a plurality of connector receptacles defining at least a portion thereof; and (b) each of said trigger shoe elements having a plurality of connector elements defining at least a portion of said matching interlocking mount geometry and being positioned for engagement within said plurality of connector receptacles.

3. The interchangeable trigger system of claim 2, wherein:

at least one retainer screw extending through a selected one of said trigger shoe elements and being received by said trigger mount for preventing sidewise lateral movement of said selected one of said trigger shoe elements relative to said trigger mount and being releasable therefrom to permit sidewise lateral movement.

4. A firearm comprising:

(a) a frame having opposed sides, a front, and a rear and having a trigger guard, a barrel and firing assembly supported by said frame and having a trigger moveable forwardly and rearwardly within said trigger guard for actuating said firing assembly;

(b) said trigger having a trigger mount defining an interlocking mount geometry; and (c) a trigger shoe having a matching mount geometry for mechanically interlocking assembly with said interlocking mount geometry and being removably assembled to said trigger mount and defining a finger engaging portion of said trigger, said interlocking mount geometry and said matching interlocking mount geometry having structure permitting assembly and removal of said trigger shoe only by lateral movement of said trigger shoe toward either side of said frame relative to said interlocking mount geometry and preventing assembly and removal of said trigger shoe with respect to said interlocking mount geometry by forward or rearward movement of said trigger shoe.

5. The firearm of claim 4, comprising:

said trigger shoe capable of being assembled to and removed from said trigger mount with said trigger located within said frame and movably positioned within said trigger guard.

6. The firearm of claim 4, comprising:

at least one retainer element releasably securing said trigger shoe against lateral movement relative to said trigger mount.

7. The firearm of claim 6, wherein:

said at least one retainer element being at least one retainer screw being threaded into said trigger mount and securing said trigger shoe in substantially fixed relation with said trigger mount.

8. The firearm of claim 4, wherein:

(a) said interlocking mount geometry having a plurality of mount bosses each defining a receptacle;

(b) said matching mount geometry of said trigger shoe having a plurality of connector elements each being capable of moving into interlocking relation with said receptacles of said interlocking mount geometry only by sidewise lateral movement of said trigger shoe with respect to said interlocking mount geometry; and (c) at least one retainer screw extending through said trigger shoe and being threadedly receivable by said trigger mount and releasably securing said trigger shoe to said trigger mount, said at least one retainer screw being releasable to permit sidewise lateral separation movement of said trigger shoe from said trigger mount.

9. The firearm of claim 4, wherein:

(a) said trigger mount having a plurality of connector receptacles; and (b) said trigger shoe having a plurality of connector elements positioned for engagement within said plurality of connector receptacles and being moveable into and from said connector receptacles by sidewise lateral movement relative thereto.

10. The firearm of claim 4, wherein:

a plurality of trigger shoes each being of differing design and dimension and each having said matching mount geometry thereon, each of said plurality of trigger shoes being selectively positionable with said matching mount geometry thereof in interlocking relation with said interlocking mount geometry.

11. A firearm comprising:

(a) a frame having opposed sides, a front, and a rear and having a trigger guard, a barrel, and firing assembly supported by the frame and having a trigger moveable forwardly and rearwardly within said trigger guard for actuating said firing assembly;

(b) a trigger mount being disposed in fixed relation with said trigger and being positionable within said trigger guard when said trigger is in assembly within said frame, said trigger mount defining an interlocking mount geometry; and (c) a plurality of trigger shoe elements of differing finger engaging geometry and dimension, each being individually selectively capable of removeable assembly with said interlocking mount geometry of said trigger mount and defining a finger engaging portion for actuating engagement by a finger of a user, each of said plurality of trigger shoe elements having matching interlocking mount geometry having structure permitting assembly and removal of each of said trigger shoe elements only by sidewise movement of each of said trigger shoe elements toward either side of said frame relative to said interlocking mount geometry and preventing assembly and removal of each of said trigger shoe elements with respect to said interlocking mount geometry by forward or rearward movement of each of said trigger shoe elements.

12. The firearm of claim 11, comprising:

at least on screw element passing through a selected one of said trigger shoe elements in assembly with said trigger mount and being releasably secured to said trigger mount for retaining the selected one of said trigger shoe elements against movement relative to said trigger mount.

13. The firearm of claim 11, wherein:

(a) said trigger mount having a plurality of connector receptacles; and (b) each of said trigger shoe elements having a plurality of connector elements positioned for interlocking engagement within said plurality of connector receptacles, said connector receptacles and said connector elements being oriented to permit assembly of a selected trigger shoe element to and removal thereof from said trigger mount only by sidewise movement relative to said frame.

* * * * *